US009777895B2

(12) United States Patent
Bokun

(10) Patent No.: US 9,777,895 B2
(45) Date of Patent: Oct. 3, 2017

(54) RETRACTABLE LIGHT STRING INSIDE AN ORNAMENT DEVICE

(71) Applicant: John Paul Bokun, New York, NY (US)

(72) Inventor: John Paul Bokun, New York, NY (US)

( * ) Notice: Subject to any disclaimer, the term of this patent is extended or adjusted under 35 U.S.C. 154(b) by 109 days.

(21) Appl. No.: 14/183,640

(22) Filed: Feb. 19, 2014

(65) Prior Publication Data

US 2014/0233234 A1 Aug. 21, 2014

Related U.S. Application Data

(60) Provisional application No. 61/767,548, filed on Feb. 21, 2013.

(51) Int. Cl.

| | |
|---|---|
| ***F21V 21/00*** | (2006.01) |
| ***F21V 27/00*** | (2006.01) |
| ***F21S 4/00*** | (2016.01) |
| ***F21V 17/00*** | (2006.01) |
| ***A47G 33/08*** | (2006.01) |
| ***F21S 4/10*** | (2016.01) |
| *F21W 121/00* | (2006.01) |

(52) U.S. Cl.

CPC ..... *F21S 4/001* (2013.01); *A47G 33/08* (2013.01); *F21S 4/10* (2016.01); *F21V 17/007* (2013.01); *F21V 27/00* (2013.01); *A47G 2033/0827* (2013.01); *F21W 2121/00* (2013.01)

(58) Field of Classification Search

CPC . F21S 4/001; F21S 4/006; F21S 4/007; F21V 17/007; F21V 27/00; F21W 2121/00; F21W 2121/04; A47G 2033/0827; A47G 33/08

See application file for complete search history.

(56) References Cited

U.S. PATENT DOCUMENTS

| | | | | |
|---|---|---|---|---|
| 2,047,045 | A | 7/1936 | Veenboer | |
| 3,752,407 | A | 8/1973 | Baugh | |
| 3,873,880 | A | 3/1975 | Riddell | |
| 3,940,521 | A | 2/1976 | Hack | |
| 4,161,021 | A | 7/1979 | George | |
| 4,452,836 | A | 6/1984 | Daniel | |
| 4,774,646 | A | 9/1988 | L'Heureux | |
| 4,833,580 | A | 5/1989 | Allen | |
| 4,923,721 | A | 5/1990 | Gilmore | |
| 5,245,519 | A | 9/1993 | Openiano | |
| 5,338,585 | A | 8/1994 | Fraus | |
| 5,598,985 | A * | 2/1997 | Winesett | 242/395 |
| 5,645,343 | A | 7/1997 | Rinehimer | |
| 5,661,953 | A | 9/1997 | Jolley | |

(Continued)

*Primary Examiner* — Alexander Garlen

(74) *Attorney, Agent, or Firm* — Michael J. Striker

(57) ABSTRACT

An ornament device for storing and deploying ornamental lights is formed as a shell or housing. The shell or housing stores and provides for deploying a string of ornament lights. The sting of ornamental lights is formed with an electrical wire interconnecting a plurality of ornamental lights interspaced along the wire that is connected on opposing wire ends to a male connector and a female connector. A retractable winding mechanism is arranged within the shell or housing for winding and maintaining the string of lights to a storage state and, for unwinding the string of lights to a deployment state.

18 Claims, 7 Drawing Sheets

(56) References Cited

U.S. PATENT DOCUMENTS

| | | | | |
|---|---|---|---|---|
| 5,772,312 | A | 6/1998 | Pihl-Niederman et al. | |
| 5,860,731 | A | 1/1999 | Marinez | |
| 5,868,490 | A | 2/1999 | Barthelmess | |
| 5,957,401 | A * | 9/1999 | O'Donnell | 242/404.3 |
| 6,228,442 | B1 | 5/2001 | Coco | |
| 6,284,330 | B1 | 9/2001 | Hermanson | |
| 6,299,095 | B1 * | 10/2001 | Murfin | 242/395 |
| 6,352,355 | B1 | 3/2002 | Law | |
| 6,386,728 | B1 | 5/2002 | Colonna | |
| 6,398,148 | B1 | 6/2002 | Snow | |
| 6,439,360 | B1 * | 8/2002 | Miller | 191/12.2 R |
| 6,598,995 | B2 | 7/2003 | Huang | |
| 6,685,340 | B2 | 2/2004 | Symonds | |
| 6,764,195 | B1 | 7/2004 | Cutliff | |
| 6,830,361 | B2 | 12/2004 | Wang | |
| 6,854,871 | B1 | 2/2005 | Morton | |
| 7,018,066 | B2 | 3/2006 | Kirven | |
| 7,252,193 | B1 | 8/2007 | Lewis et al. | |
| 7,661,855 | B2 | 2/2010 | Matthew et al. | |
| 7,878,684 | B2 | 2/2011 | Naumann | |
| 7,914,168 | B2 | 3/2011 | Oliva | |
| 8,136,962 | B2 | 3/2012 | Marlonia | |
| 8,356,926 | B1 | 1/2013 | Sanders | |
| 2001/0024303 | A1 | 9/2001 | Odhner et al. | |
| 2002/0089850 | A1 | 7/2002 | Wang | |
| 2002/0089859 | A1 | 7/2002 | Jackson | |
| 2002/0159256 | A1 | 10/2002 | Chen | |
| 2003/0156405 | A1 | 8/2003 | Kim | |
| 2003/0218878 | A1 | 11/2003 | Swaris | |
| 2004/0084271 | A1 * | 5/2004 | Woodruff | 191/12.2 R |
| 2005/0161359 | A1 * | 7/2005 | Shaffer | 206/419 |
| 2005/0185400 | A1 | 8/2005 | Hsu | |
| 2005/0254231 | A1 | 11/2005 | Wu | |
| 2006/0054760 | A1 * | 3/2006 | Murry | 248/248 |
| 2006/0158878 | A1 | 7/2006 | Howell | |
| 2007/0183147 | A1 | 8/2007 | Herlands | |
| 2008/0158904 | A1 | 7/2008 | Lai | |
| 2008/0191084 | A1 * | 8/2008 | Prats | 242/390.8 |
| 2009/0091266 | A1 * | 4/2009 | Garrett | 315/185 S |
| 2011/0038160 | A1 * | 2/2011 | Kountotsis | 362/249.16 |
| 2011/0122625 | A1 | 5/2011 | Carone | |
| 2012/0002417 | A1 | 1/2012 | Li | |

* cited by examiner

RETRACTABLE LIGHT STRING INSIDE AN ORNAMENT DEVICE

CROSS-REFERENCE TO A RELATED APPLICATION

This application claims priority under 35 U.S.C. §119 from U.S. Provisional Patent Document No. 61/767,548, filed Feb. 21, 2013, all of the contents of which are incorporated by reference herein.

BACKGROUND OF THE INVENTION

The present invention relates broadly to Christmas lights and, relates more particularly to a an ornament device that houses a string of ornamental lights (or light string) on a retractable winding mechanism configured to unwind to deploy the light string, wind to secure the deployed light string (after use), where the light string has a male electrical connector at one end and a female electrical connector at its other end for powering and concatenating multiple ornament devices/light strings.

Ornamental light strings, e.g., Christmas light strings, come in many shapes and sizes for use both indoors (for example, on an indoor tree) and outside (for example, on a house trim or on branches of a tree). Once removed from packaging after purchased, and deployed, ornamental light strings can be troublesome to wrap up or otherwise arrange for storage and then stored for the string's "next" deployment, typically about one year later. That is, the light string is typically wound in multiple loops as one might wind a common light extension cord. The string of lights also can be wound around an object and stored. But if an ornamental light string is wrapped around an object for storage, there is much space wasted. If they are folded over, or wound in multiple loops, the light strings likely tangle and, therefore, must be untangled.

Ornamental light strings are likely to tangle when wound for storage because unlike a common extension cord, the strings have multiple light elements that extend out from the line of the wire. The extending light elements operate to readily tangle by contact with the wire and prevent the stored light string from being easily redeployed. Put another way, one typically must untangle stored ornamental light strings before redeployment every (the next) year, which can be both challenging and frustrating. For that matter, conventional ornamental light strings, when arranged for storage, typically take large amounts of space for storage.

SUMMARY OF THE INVENTION

The present invention overcomes the shortcomings of known arts, such as those mentioned above.

To that end, the present invention provides an ornament object or device in a form of ornament device (e.g., a Christmas ornament) that maintains a length of electrical wire that serially interconnects an array of ornamental lights ("string of lights") in an inner volume of the ornament device, in a way in which tangling is minimized, prior to and during deployment. The string of lights is maintained in the inner volume by winding about a central winding mechanism, including inter alia a retractable winch. Preferably, a surface area of the winch (i.e., a central member) is configured to reel and maintain a first layer of the light string when wound for storage in a loops starting at one end of the central (winding) member and extending axially to the other end.

Opposite ends of the electrical wire comprising the string of lights are fitted with male and female electrical connectors, respectively.

The male connector is plugged into a source of AC power. In a preferred embodiment, the female connector is arranged in a fixed immobile position on the ornament, accessible to an extension cord, where the end comprising the male connector is pulled away (through an opening) from the ornament device with some portion of the light string. In this case both the ornament device and the light string are deployed as an integral unit. For deployment, the light string with the male connector is extracted (for example, unwound) from the central winding means or winch and the ornament hung or fixed on a tree or other object to be adorned (or merely pulled by one hand while the other hand grips the ornament device).

If more than one ornament and light string is deployed, the male connector of the first string is plugged into the female connector of the second string (or ornament in the preferred embodiment), to concatenate the two strings. Any number of strings may be concatenated. The ornaments with the strings of lights are positioned on a tree or other object for adornment. The invention, however, is not limited to the embodiment so described. In a variation, the female connector also may be pulled away from the ornament device through the same opening or through a second opening disposed opposite the first opening (through which the male connector and light string is drawn away. For that matter, the central member comprising the winch mechanism may be configured with two axial sections to allow that each may wind/unwind in a direction opposite the other to accomplish the two-way winding/unwinding.

It should be noted that the entire length of the light string need not be deployed in any of the light string ornaments, because device or ornament keeps the lights (on the wire) inside with the retractable mechanism. The length of the light string (and amount of lights, therefore, are pulled out as needed. When the lights are no longer needed, the light string comprising same is safely retracted back inside the device or ornament. While the preferred embodiment has the light string formed integrally with the ornament construction, the invention is not limited thereto. The light string and ornament housing may be separate devices, so that the light string may be deployed with deploying the ornament, if desired.

A person would hang the ornament device from a Christmas tree and extract the lights and wrap them around the tree. After the lights are taken down, the person can retract the string of lights into the ornament devices and store the ornament devices in a box. Since ornament devices are already needed for a Christmas tree, the space used for regular lights would be saved and no longer needed to light the tree. Additionally, a retractable set of lights could be multi-functional. Such as temporary lighting used outdoors or in areas not completely hooked up electrically.

As should be clear, the ornament device could be used for lighting dark areas over long distances and set a trail for people following another person, or easily backtracking and turning lights off behind you by simply coiling the lights as you walk backwards.

In an embodiment, the inventive ornament device for storing and deploying ornamental lights is formed as a shell or housing, preferably spherical or puck-like. The shell or housing stores and provides for deploying a string of ornament lights. The sting of ornamental lights is formed with an electrical wire interconnecting a plurality of ornamental lights interspaced along the wire that is connected on opposing wire ends to a male connector and a female connector. A retractable winding mechanism is arranged within the shell or housing for winding and maintaining the string of lights to a storage state and, for unwinding the string of lights to a deployment state.

In another embodiment, the invention provides an ornament device for storing and deploying ornamental light cord. The ornament device comprises a shell or housing, a light cord formed with an electrical wire interconnecting a plurality of LED lights interspaced along the electrical wire, wherein the electrical wire is connected on opposing wire ends to a male connector and a female connector, respectively and an entire length of the light cord displays a cross-section that is substantially the same. The ornament device also comprises a retractable winding mechanism arranged within the shell or housing for winding and maintaining the light cord in a storage state and, for unwinding the light cord to a deployment state.

The retractable winding mechanism includes a spool that is rotatable about a central member that extends axially between a top and a bottom of the ornament device, and upon with the light cord is wound in the storage state and unwound to the deployment state. The spool includes disc-like sides for maintaining the light cord in the storage state.

In one form, the retractable winding mechanism includes a spring-based retractable winding mechanism that stores retracting energy in a spring when the light cord is unwound and utilizes the spring-stored energy to rewind the light cord upon actuation of retractable winding mechanism to rewind the light cord. The retractable winding mechanism includes a push-button actuator that is pushed to rewind the light cord. Preferably, the light cord is configured with a light emitting element that is substantially continuous for a portion of the length of the light cord, wherein the light cord is either substantially flat or substantially cylindrical.

The ornament device of claim 13, wherein the light cord is encased in a clear or translucent plastic material to seal the electrical wire and lights from the environment and to prevent tangling in the storage state.

BRIEF DESCRIPTION OF THE DRAWINGS

Further features and advantages of the invention will become apparent from the description of embodiments that follows, with reference to the attached figures, wherein:

FIG. 40 depicts a light cord holding mechanism in the form of a spool;

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

As stated above, ornamental lights or light strings (e.g., Christmas lights or Christmas tree lights) are troublesome to wrap up and put away and, further troublesome to redeploy the next year. Ornamental light strings also require relatively large amounts of space for storage.

Figure 1A:
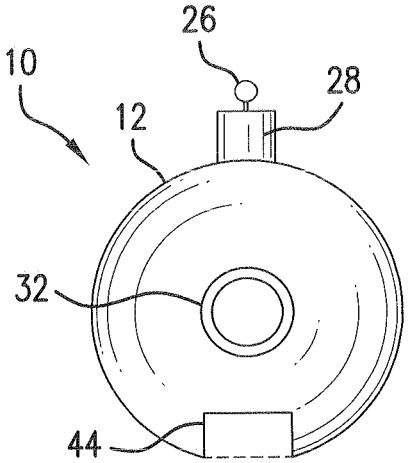
FIG. 1A presents a front view of one embodiment of an ornament device for storing and deploying a string of ornamental lights according to the invention.
Figure 1B:
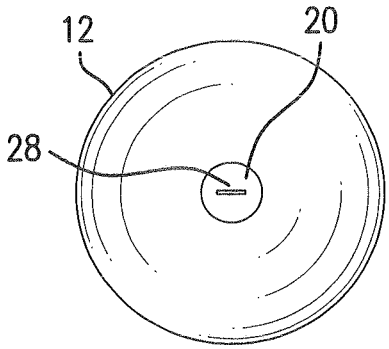
FIG. 1B presents a top view of the ornament device for storing and deploying a string of ornamental lights, as shown in FIG. 1A.
Figure 1C:
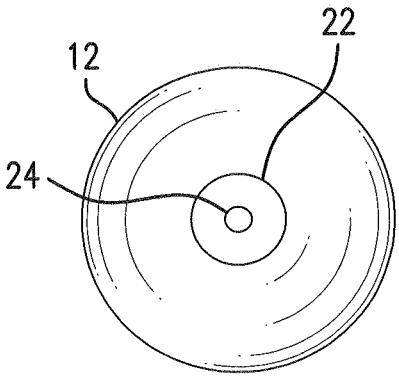
FIG. 1C presents a bottom view of the ornament device for storing and deploying a string of ornamental lights, as shown in FIG. 1A.
Figure 1D:
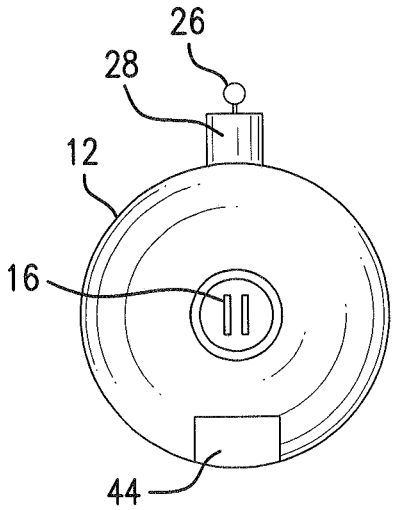
FIG. 1D presents a rear view of the ornament device for storing and deploying a string of ornamental lights, as shown in FIG. 1A.
Figure 2A:
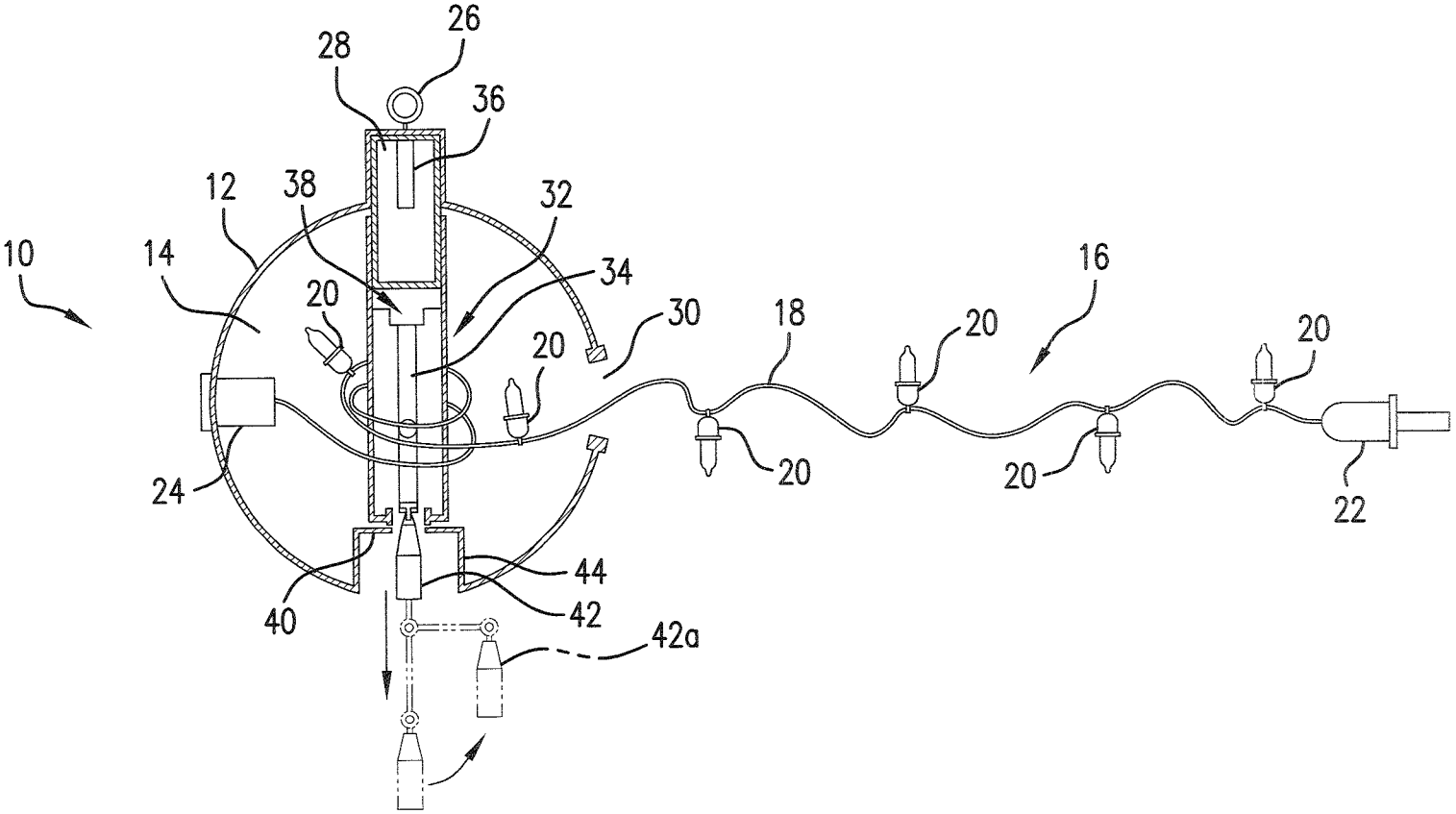
FIG. 2A presents a front sectional view of the ornament device for storing and deploying a string of ornamental lights, as shown in FIG. 1A.

FIGS. 1A, 1B, 1C and 1D show respective front, top, bottom and rear view of one embodiment of an ornament device 10 for storing and deploying an electrical string of ornamental lights according to the invention. FIG. 2A shows a section view to highlight operation of the ornament device 10, which overcomes the problems of associated with storing and deploying (or redeploying) ornamental light strings (e.g., Christmas). As shown, ornament device 10 is shaped like a conventional Christmas tree ornament (but also could be puck-shaped or shaped like a pumpkin for Halloween). The ornament device 10 (as depicted in FIGS. 1A, 1B, 1C, 1D, 2A, 2B and 3) is constructed as a hollow spherical shell or housing 12 (preferably plastic), with an inner shell volume 14 for storing a string of ornamental lights 16. Please note, however, that the shell 12 of the ornament device 10 is shown in the figures to be spherical-shaped, the invention is not limited thereto. The shape of the ornament device may be disc or puck-like, rectangular, triangular, etc., as long as it operates as described hereinafter, without deviating from the scope and spirit of the invention.

The string or ornamental lights 16 comprises an electrical wire 18 electrically interconnecting a plurality of lights 20 between a male electrical plug or connector 22 on one end and a female electrical plug or connector 24 on the other end (preferably fixed in place at an opening in the spherical shell, but not limited thereto; see FIG. 2B, as described below). The male electrical plug or connector 22 is arranged to connect to a source of AC power, such as through an electrical extension cord, to light up the light string 16. Please note that lights 20 may be conventional incandescent lights or may comprise LED light elements. The light string, or concatenated light strings, may be electrically powered by alternating current (AC) or by direct current (DC).

For that matter, the light string (or light cord as described below) may include a USB-type connector at one or both ends to enable the string/cord or set of concatenated strings/cords to be powered and controlled through the USB-type connector, for example, by a computer system such as a computer server or a hand-held computer based electronic device. In a variation, the light string/cord may be connected at one end and powered by a DC battery positioned in the inner volume 14, for example, attached to an inner wall of shell 12. In that case, the battery may be rechargeable and part of a battery system that includes a charger, with an opening in the shell wall to access a source for recharging the battery.

An eyelet or mounting device 26 is attached to a cylindrical top portion 28 of the ornament device 10, attached to or formed integrally with the spherical shell portion 14. The eyelet 26 is provided in order to hang the ornament device 10 from a tree limb (real or artificial, indoors or outdoors), or other device or structure. FIG. 2A shows the string of lights 16 extended from an opening 30 in the shell 12, with male connector 22 at its outer end.

The ornament device 10 includes a winding mechanism (or coil unit) 32 for collecting by winding and releasing by unwinding the string of lights 16 into/out of the inner shell volume 14. The winding mechanism 32 includes a central member 34 attached at an upper end to a swivel mechanism 36 located in the cylindrical top portion of the ornamental device 28. The cylindrical top portion of the ornamental device 28 is reinforced as shown and, the swivel mechanism is attached to the hook 26, as shown.

A first retractable gear device 38 is shown attached to the cylindrical top portion of ornamental device at a portion thereof that extends vertically downward (see FIG. 2) into the inner shell volume, coaxially surrounding the central member 34. The central member passes through or extends from the center of the first retractable gear device 38, which is fastened thereby to the central member 34. The other end of winding mechanism 32 is connected to a second retractable gear device 40, which include cogs that mesh with coil unit cogs to transmit torque to the central member, to wind in a clockwise or counterclockwise direction, when a retractable winch 42 is extended out from a recessed opening 44 by a user in order to apply a winding or unwinding force.

Please note that while the retractable winch 42 is shown in its recessed position in the recessed opening 44, FIG. 2 also shows the retractable winch in an extended and deployed state (42*a*) in shadow. The second retractable gear device 44 is fixed at the inner part of the recessed opening 44 and enables operation of the retractable winch 42, connected to the lower end of the central member 34, in cooperation with the first retractable gear device 38.

Using the retracting mechanism to collect and maintain the string of lights (by winding thereon) in the inner volume, to deploy/redeploy the string of lights (by unwinding therefrom) provides for trouble free use, saving time and saving space typically consumed by use and storage of conventional ornamental (e.g., Christmas) light strings. The inventive ornament device can be hung on a tree and the light string deployed from the retracting mechanism wrapped around or upon the tree branches. The string of lights within (and preferably including) each ornament device can be physically concatenated with and, electrically connected (in series) to another string of lights/ornament device. This is carried out by connecting the male connector at the (outer) end of the light string to the female connector preferably fixed on the ornament device, which provides a continuous current pathway for the lights in the "another" string of lights/ornament device.

This ornament device maintains the ornamental lights within the inner volume with the retractable mechanism 32. Therefore, a particular length of the lights can be pulled out from the inner shell volume as needed. When no longer needed, the length of lights so deployed can safely retract back inside the ornament device. The lights comprising the light string of the ornament device can be used for lighting dark areas over long distances as well as setting a trail for others following a person, or easily backtracking and turning lights off behind you by simply coiling the lights as you walk backwards.

That is, the invention is used by accessing the retractable winch 42, extracting it from the recessed opening 44, which engages the cogs and the first retractable gear device 38 and the second retractable gear device 40. Then, as the user turns the winch a winding or unwinding torque is applied to the turn the central member 34, which either wraps the wire 18 or unwraps the wire 18 about the central member. Preferably, opening 30 is limited in size so that the male connector 22 cannot be pulled completely into the inner volume 14.

Most preferably, the winding mechanism 32, central member 34, swivel mechanism 36, first retractable gear device 38, second retractable gear device 40 and retractable winch 40 are configured so that during winding and unwinding, the user is able to lock a rotational position of the central member as it rotates, at spaced intervals. This enables that a particularly desired length of the string of lights 16 may be defined for a particular application. For that matter, it is preferred that the ornament device 10 and string of lights 16 are configured with double redundancy wiring for the lights, to assure individual lights 20 will not fail or cause a line of lights 16 to fail. Regular light bulbs can be substituted for LED lights. Mini USB wiring can be substituted for regular male and female plugs. Most preferably, the retractable mechanism can be made to spin around itself or up and down in a spiral.

Please note that the invention is not limited to the embodiment described in detail in FIG. 2A. FIG. 2B shows a variation in which the female connector 24 also may be pulled away from the ornament device through the same opening 30 or through a second opening 30' disposed opposite the first opening (through which the male connector and light string is drawn away). For that matter, the central member 34 comprising the winch mechanism may be configured with a central member comprising two separable axial sections that are able to be driven and rotate in opposite rotational directions concurrently. Such an arrangement thereby allows for different portions of the light string length (for example, halves leading with the male and female connectors, respectively) to unwind in directions opposite the other to accomplish the two-way unwinding. Doing so also requires a device in the winding mechanism 32 to enable one or the other separate axial sections to be engaged by the winch wind elements that allows winding first one and then the other. For that matter, the different portions of the light string may be stored on separate spools in the inner volume.

Figure 3:
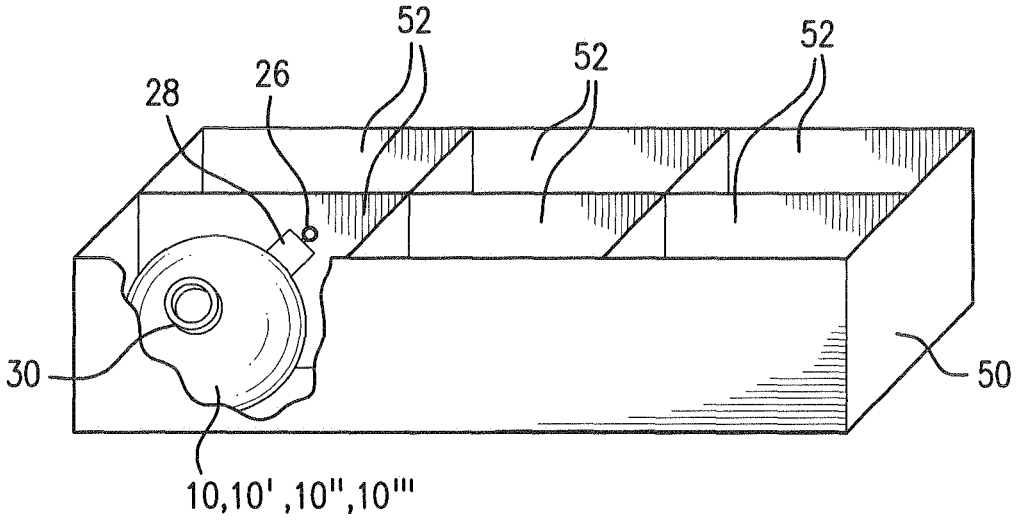
FIG. 3 presents a front perspective view of a container for maintaining a number of the ornament devices for storing and deploying a string of ornamental lights.

FIG. 3 presents a front perspective view of a container 50 for maintaining a number of the ornament devices 20 in separate container compartments 52 for storing and deploying an electrical string of ornamental lights contained in the devices.

Figure 4A:
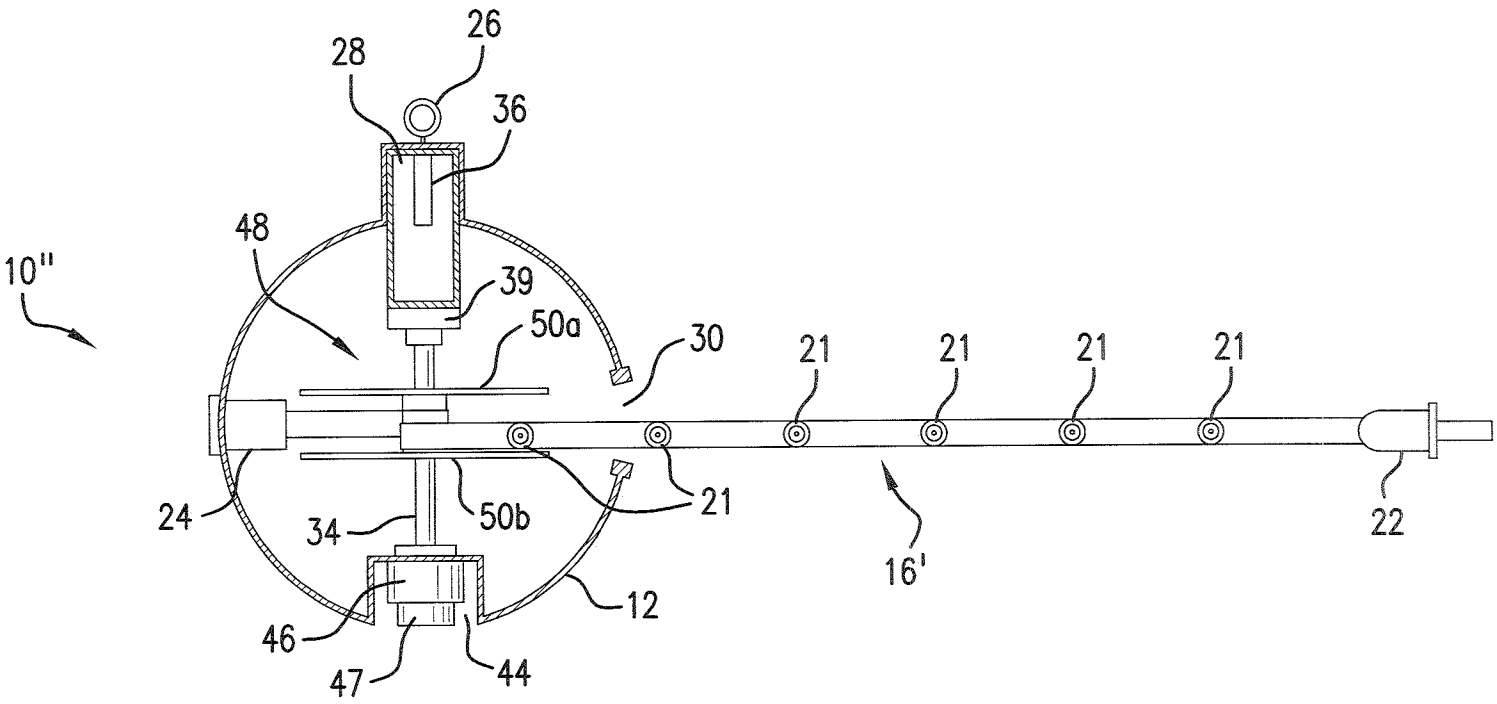
FIG. 4A presents a front sectional view of an alternative embodiment of the ornament device for storing and deploying an ornamental light cord formed with LED light-generating devices, enveloped by a clear, plastic outer jacket or cover.
Figure 4B:
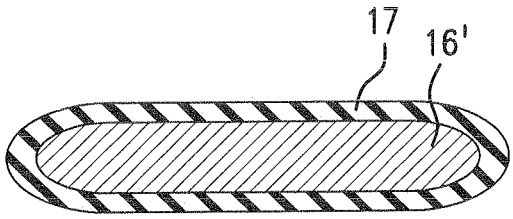
FIG. 4B depicts a cross-section of one embodiment of a light cord 16' with a clear plastic outer jacket or cover.
Figure 4C:
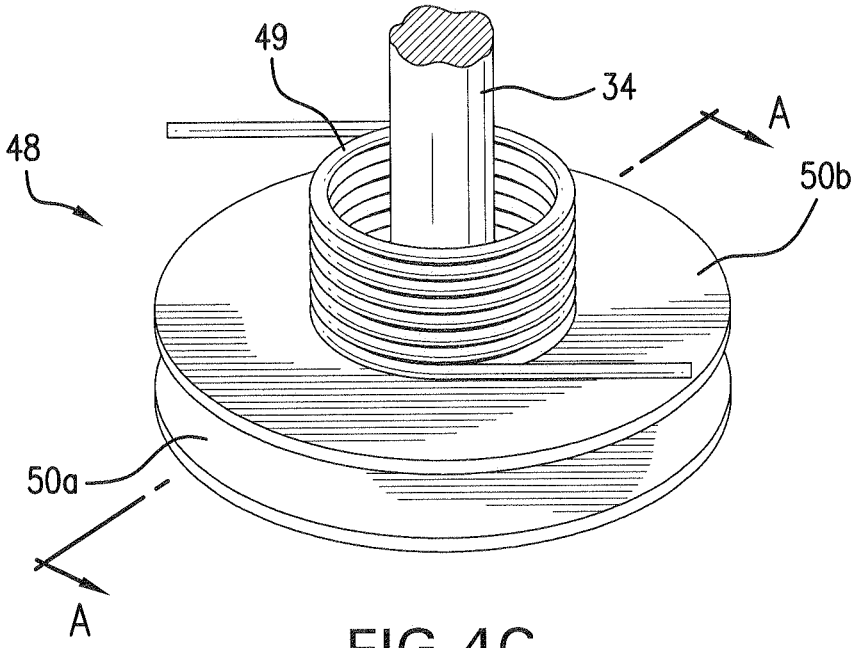
FIG. 4D depicts a sectional view of the light cord holding mechanism/spool of FIGS. 4A, 4C, along the lines A-A of FIG. 4B.
FIG. 4E depicts a light cord that emits light contiguously along substantially its entire length when excited or driven by an AC or DC electrical power source.

FIGS. 4A, 4B and 4C together depict an alternative embodiment of the inventive ornament device 10". FIG. 4A shows ornament device with a light cord 16' including light devices 21, preferably LED devices that are incorporated in the length of the light cord 16' and electrically connected in series between the male 22 and female 24 connectors, as shown. The light cord 16', including the light devices 21 (which are spaced between 3 and 10 inches apart (6 inches exactly in a preferred embodiment). is enveloped in a preferably clear, transparent, flexible plastic outer jacket 17. The plastic outer jacket 17 maintains an electrical wire serially interconnecting the light devices 21, or a pair of electrically wires configured for electrically interconnecting the light devices 21 in parallel in a way in which same (and the wire) are insulated and protected from the environment, but also to ensure that the outer light cord surface is smooth, which the same cross-section dimension to prevent tangling when winding and unwinding.

FIG. 4B shows one embodiment of light cord 16' with plastic or rubber-light outer jacket 17. The light cord 16' shown in FIG. 4B is substantially flat or tape-like. While the light cord 16' shown in FIG. 4B is substantially flat or tape-like, but not limited to that shape.

Figure 2B:
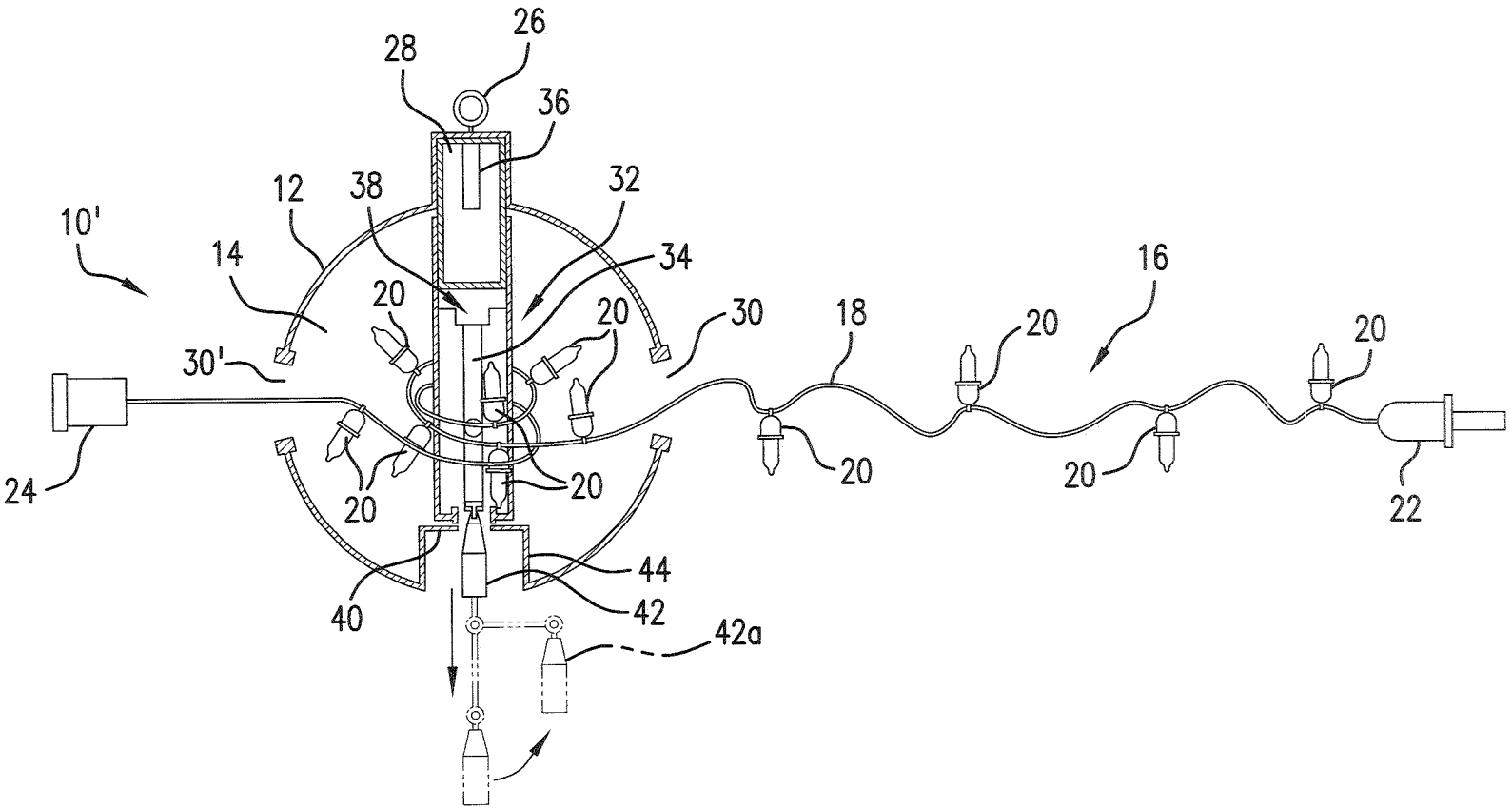
FIG. 2B presents a front sectional view of an alternative embodiment of the ornament device for storing and deploying a string of ornamental lights of the invention.

The ornament device 10" differs from the ornament device embodiments of FIGS. 2A and 2B in that it includes a light cord holding mechanism 48 in the form of a spool with first and second disk-like sides 50*a* and 50*b*. The first and second disk-like sides 50*a* and 50*b* extend radially from outer extremities of an inner cylindrical section (not shown), defining a cylindrical opening through the axial center. The central member 34 passes through the axial center of the mechanism/spool 48, which central member connects to an upper lock/retract mechanism 39 and a lower lock/retract mechanism 46. The light cord holding mechanism/spool 48 includes a spring with gears, ratchet, pawl, button for locking and releasing the spool, as is known.

Figure 4D:
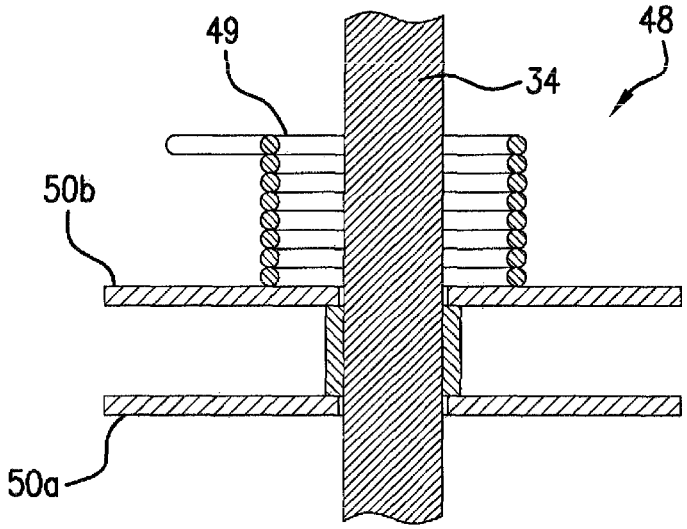

FIG. 4C shows a light cord holding mechanism/spool 48 in a side perspective view (highlighting the spring 49), where FIG. 4D shows a section view of the light cord holding mechanism/spool 48 with a portion of central members passing through its axial center. Preferably, an axial bearing is positioned on an outer surface of the central member that contacts and facilitates rotation of the light cord holding mechanism/spool 48. The lower spring loaded lock/retract mechanism 46 is positioned in recess 44 and includes an accessibly button actuator 47. At least one of and preferably both of the upper 39 and lower 46 spring loaded lock/retract mechanisms include spring devices 49.

The spring devices 49 operate with the central member like many conventional tape measures and like wire retraction device. The spring devices 49 (in cooperation with central member 34 and upper 39 and lower 46 spring loaded lock/retract mechanisms), operate to store energy for retracting a wire or tape when the wire or tape is extracted from a housing (rotating a central member in one rotational direction). That is, the springs are wound to the point where extraction stops and the extended cord (or light string 16 as shown in FIG. 2) is fixed in place to prevent instant retraction.

In one embodiment, the mechanism/spool 48 contains a steel torsional spring 49 which provides the force to retract the light cord. A ratcheting mechanism allows the spool on which the light cord is wrapped to lock in different rotational configurations. The ratcheting mechanism consists of a spring-loaded pawl and gear. The gear is fabricated with teeth covering approximately two thirds of the circumference. The remaining one third of the circumference has no teeth and a small radius; this results in the pawl slipping on the teeth in only one direction, but when it is in the toothless region it has the ability to switch directions, i.e. allowing the light cord to retract freely. Please note, however, that the invention is not limited to the spring loaded lock/retract mechanism so described, which is presented for exemplary purposes only.

The spring 49 is a torsion spring which is more like a disc then a cylinder. The spring 49 is housed in a gear (as part of the mechanism/spool 48) that has teeth that are curved on one side. The locking mechanism is a plastic stop that catches the gear and holds it in place. A half or short pull will allow the lock to turn around and allow the spring to pull back.

Figure 4E:
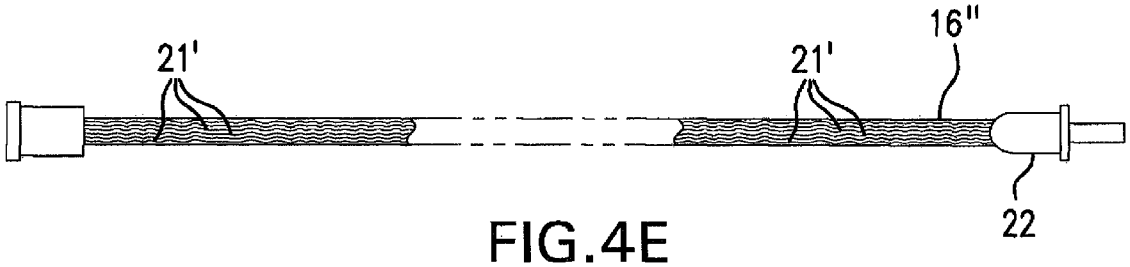

Pressing the button actuator 47 releases the lock hold on the extending light cord 16' or light string 16, relying of the stored (wound) spring 49 energy to spin the light cord holding mechanism/spool 48 in the opposite direction to collect the cord therein (between the disc-like sides 50*a*, 50*b*). In an alternative to the FIG. 4A embodiment, FIG. 4E shows a light cord 16" that is utilized in an ornament device such as depicted in FIGS. 2A, 2B and 4A. Light cord 16" differs from light cord 16' (and light string 16) in that it emits light contiguously along substantially its entire length when excited or driven by an AC or DC electrical power source. Element 21' in FIG. 4E represents the portion of light cord 16" that lights up when excited.

Please further note with request to the embodiments of FIGS. 4A, 4B, 4C, 4D and 4E, the female connector 24 end of the light cords 21, 21' may be extracted from a second opening 30' in a part of the shell 12 position substantially opposite that of opening 30, as shown, without deviating from the scope and spirit of the invention. So like the embodiment depicted in FIG. 2B, this alternative embodiment allows for extracting (unwinding) the light cord 16', 16" from opposing openings 30, 30', and collecting (winding) the light cord 16', 16" into opposing openings (in light cord holding mechanism/spool 48 mounted to rotate about central member 34) when drawn or actuated by button 47, respectively.

LIST OF ELEMENTS

10 ornament device
10' ornament device
10" ornament device
12 spherical shell or housing
14 inner shell volume
16 string of lights
16' light cord
16" light cord
17 plastic or rubber-light outer jacket
18 electrical wire
20 lights (incandescent)
21 lights (LED or other "light-cord" lights)
21' singly light emitter mechanism extending along length of light cord 16"
22 male electrical plug or connector
24 female electrical plug or connector
26 eyelet
28 cylindrical top portion of ornamental device
30 opening
30' opposing opening
32 winding mechanism
34 central member
36 swivel mechanism
38 first retractable gear device
39 upper spring-loaded lock/retract mechanism
40 second retractable gear device

42 retractable winch
42*a* retractable winch in an extend state (42*a*)
44 recessed opening
46 lower spring loaded lock/retract mechanism
47 actuator button
48 light cord holding mechanism
49 spring device
50*a* disc-shaped wall
50*b* disc-shaped wall As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. An ornament device for storing and deploying ornamental lights, the ornament device comprising:

a shell or housing;

a string of lights formed with an electrical wire interconnecting a plurality of ornamental lights interspaced along the electrical wire, wherein the electrical wire is connected on opposing wire ends to a male connector and a female connector, respectively; and a retractable winding mechanism embodying a retractable winch, the winch arranged wholly within a recess or opening in the shell or housing in a non-deployed state and retrieved from the recess or opening in the shell or housing to a deployed state for winding the light cord to a storage state inside the shell or housing and, to unwind the light cord from inside the shell or housing for deployment outside the shell or housing;

wherein the retractable winding mechanism includes a spool that is attached to and rotatable with a central member, which central member extends axially between a top and a bottom of the ornament device, and wherein the light cord is wound on the spool in the storage state and, a wound cord is unwound from the spool for deployment.

2. The ornament device of claim 1, wherein the retractable winch is positioned within and retractable from a recess opening in the shell or housing.

3. The ornament device of claim 2, wherein the retractable winch is extracted from the recess to engage the central member and to rotate the central member.

4. The ornament device of claim 1, wherein the retractable winding mechanism winds and unwinds the string of lights from the central member through an opening in the shell or housing.

5. The ornament device of claim 4, wherein the retractable winding mechanism winds and unwinds a portion of the string of lights from the spool through a first opening in the shell or housing and winds and unwinds another portion of the string of lights from the spool though a second opening in the shell or housing, which is disposed substantially opposite the first opening.

6. The ornament device of claim 1, wherein the retractable winding mechanism comprises a first and a second retractable gear device.

7. The ornament device of claim 1, further comprising an eyelet for deploying the ornamental device, and a swivel mechanism connecting the eyelet to the shell or housing.

8. The ornament device of claim 7, wherein the swivel mechanism is connected or coupled to the retractable winding mechanism via the central member.

9. The ornament device of claim 1, wherein the shell or housing is spherical.

10. The ornament device of claim 1, wherein the shell or housing is puck-like.

11. An ornament device for storing and deploying ornamental light cord, the ornament device comprising:

a shell or housing;

a light cord formed with an electrical wire interconnecting a plurality of LED lights interspaced along the electrical wire, wherein the electrical wire is connected on opposing wire ends to a male connector and a female connector, respectively and an entire length of the light cord displays a cross-section that is substantially the same; and a retractable winding mechanism including a winch arranged within the shell or housing and configured to be retrieved from the shell or housing for winding the light cord about a central member within the shell or housing to a storage state and, for unwinding the light cord from the central member in the shell or housing for deployment outside the shell or housing, the winch retracted back into the shell or housing when not required for winding or unwinding the light cord;

wherein the retractable winding mechanism is connected to the central member and rotating the winding mechanism rotates the central member.

12. The ornament device of claim 11, wherein the retractable winding mechanism includes a spool attached to and rotatable with the central member that extends axially between a top and a bottom of the ornament device, and wherein the light cord is wound upon the spool to the storage state and unwound from the spool for deployment.

13. The ornament device of claim 12, wherein the spool includes disc-like sides for maintaining the light cord in the storage state.

14. The ornament device of claim 11, wherein the retractable winding mechanism is a spring-based retractable winding mechanism that stores retracting energy in a spring when the light cord is unwound and utilizes the spring-stored energy to rewind the light cord upon actuation of the retractable winding mechanism to rewind the light cord.

15. The ornament device of claim 14, wherein the retractable winding mechanism includes a push-button actuator that is pushed to rewind the light cord.

16. The ornament device of claim 11, wherein the light cord is configured with a light emitting element that is substantially continuous for a portion of the entire length or the light cord.

17. The ornament device of claim 11, wherein the light cord is either substantially flat or substantially cylindrical.

18. The ornament device of claim 11, wherein the light cord is encased a clear or translucent plastic material to seal the electrical wire and lights from the environment and to prevent tangling in the storage state.

* * * * *